US009725997B2

(12) United States Patent
Pinkston et al.

(10) Patent No.: US 9,725,997 B2
(45) Date of Patent: Aug. 8, 2017

(54) ARMORED POWER CABLE INSTALLED IN COILED TUBING WHILE FORMING

(71) Applicant: Baker Hughes Incorporated, Houston, TX (US)

(72) Inventors: Tim W. Pinkston, Chelsea, OK (US); Don C. Cox, Southlake, TX (US)

(73) Assignee: Baker Hughes Incorporated, Houston, TX (US)

( * ) Notice: Subject to any disclaimer, the term of this patent is extended or adjusted under 35 U.S.C. 154(b) by 67 days.

(21) Appl. No.: 14/826,422

(22) Filed: Aug. 14, 2015

(65) Prior Publication Data

US 2016/0047210 A1 Feb. 18, 2016

Related U.S. Application Data

(60) Provisional application No. 62/037,972, filed on Aug. 15, 2014.

(51) Int. Cl.
*E21B 43/12* (2006.01)
*E21B 17/20* (2006.01)

(52) U.S. Cl.
CPC ..... *E21B 43/128* (2013.01); *E21B 17/206* (2013.01)

(58) Field of Classification Search
CPC ..... E21B 19/084; E21B 43/128; E21B 17/206
See application file for complete search history.

(56) References Cited

U.S. PATENT DOCUMENTS 4,681,169 A 7/1987 Brookbank, III
5,146,982 A * 9/1992 Dinkins ..... E21B 17/206 166/65.1
5,191,173 A 3/1993 Sizer et al.
5,269,377 A * 12/1993 Martin ..... E21B 17/003 166/385
5,782,301 A 7/1998 Neuroth et al.
5,821,452 A 10/1998 Neuroth et al.
5,920,032 A 7/1999 Aeschbacher et al.
6,143,988 A 11/2000 Neuroth et al.
6,167,915 B1 1/2001 Collie et al.
6,260,615 B1 7/2001 Dalrymple et al.
6,479,752 B1 * 11/2002 Neuroth ..... E21B 17/1028 174/106 R
6,585,046 B2 7/2003 Neuroth et al.
6,695,062 B2 2/2004 Dalrymple et al.
7,044,223 B2 5/2006 Dalrymple et al.
7,905,295 B2 3/2011 Mack
8,272,448 B2 9/2012 Mack
2012/0167375 A1 7/2012 Pesek et al.

FOREIGN PATENT DOCUMENTS

GB 2461482 B * 2/2012 ..... F16L 11/081

* cited by examiner

*Primary Examiner* — David Bagnell
*Assistant Examiner* — Brandon Duck
(74) *Attorney, Agent, or Firm* — Bracewell LLP; James E. Bradley

(57) ABSTRACT

An electrical submersible well pump assembly includes a pump driven by an electrical motor. A string of tubing connects to the well pump assembly and extends to an upper end of a well. A power cable installed in the tubing has three insulated electrical conductors embedded within an elastomeric jacket. A metal strip has turns wrapped helically around the jacket. The metal strip is compressed between the jacket and the tubing to cause the power cable to frictionally grip the tubing.

15 Claims, 4 Drawing Sheets

ARMORED POWER CABLE INSTALLED IN COILED TUBING WHILE FORMING

CROSS REFERENCE TO RELATED APPLICATION

This application claims priority to provisional application 62/037,972, filed Aug. 15, 2014.

FIELD OF THE DISCLOSURE

This disclosure relates in general to electrical submersible pumps for wells and in particular to an armored power cable installed within coiled tubing while the coiled tubing is being formed.

BACKGROUND

Electrical submersible pumps (ESP) are often used to pump fluids from hydrocarbon wells. An ESP includes a motor, a pump, and a seal section that reduces a pressure differential between well fluid on the exterior and dielectric lubricant in the motor interior. An ESP may have other components, such as a gas separator or additional pumps, seal sections and motors in tandem.

A power cable extends from the surface to the motor for supplying three-phase power. Usually, the power cable has three conductors, each of which is separately insulated. A single elastomeric jacket is extruded over the three insulated conductors. A metal strip or armor wraps around the jacket. In round cable, the exterior of the jacket is cylindrical in cross-section. In some installations, a tube extends alongside the armor of the power cable. The tube may be used to convey liquids, or the tube may have an instrument wire located inside. It is known to wrap the tube and the armor together with another metal strip.

In most cases, a string of production tubing supports the ESP, and bands secure the power cable to and alongside the production tubing. When the ESP has to be retrieved for repair or replacement, a workover rig is required to pull the tubing along with the power cable and ESP.

It is desirable to avoid having to employ a workover rig to retrieve the ESP. However, a conventional power cable cannot support its own weight in many wells, thus needs additional support. One technique involves placing the power cable within coiled tubing, which is a continuous length of metal tubing deployed from a reel. The pump discharges up an annular space surrounding the coiled tubing.

Various methods have been proposed and employed to transfer the weight of the power cable to the coiled tubing. In one method, the power cable with armor is pulled through the coiled tubing after the coiled tubing has been formed. Various standoffs or dimples formed in the coiled tubing engage the armor to anchor the power cable within the coiled tubing. In another method, the power cable without an armor is placed in the coiled tubing as the coiled tubing is being formed and seam welded.

SUMMARY

An electrical submersible well pump assembly includes a pump driven by an electrical motor. A string of tubing connects to the well pump assembly and extends to an upper end of the well. A power cable installed in the tubing has three insulated electrical conductors embedded within an elastomeric jacket. A metal strip has turns wrapped helically around the jacket. The metal strip is compressed between the jacket and the tubing to cause the power cable to frictionally grip the tubing.

Each of the turns of the metal strip overlap with adjacent ones of the turns. Preferably, when viewed in a transverse cross section, each of the turns of the metal strip has a generally S-shaped configuration, defining an outward facing curved valley and an inward facing curved valley, relative to a centerline of the power cable. The inward facing curved valley of each of the turns of the metal strip overlaps the outward facing curved valley of an adjacent one of the turns.

Each of the outward facing and inward facing curved valleys has an edge at a margin of the metal strip. The edge of the inward facing curved valley may be in contact with an outer surface of the outward facing curved valley. The edge of the outward facing curved valley may be in contact with an inner surface of the inward facing curved valley.

Preferably, the metal strip is elastically deformed between the jacket and the tubing. Prior to installation of the power cable in the tubing and after the metal strip is wrapped around the jacket, the metal strip has a radial dimension between an inner side and an outer side that is greater than the radial dimension of the metal strip after installation of the power cable in the tubing.

The power cable may have at least one tube embedded within the jacket alongside the conductors and extending along a length of the power cable. Multiple tubes may be embedded is the jacket and symmetrically spaced relative to a centerline of the power cable. The tube may house an instrument wire or it may be used to convey fluids.

Alternately, the tube may extend alongside and exterior of the jacket. If on the exterior of the jacket, each turn of the metal strip extends around the tube and the jacket. The power cable may have an inner armor strip wrapped helically around the jacket with the tube located exterior of and in contact with the armor strip. The metal strip wraps around the inner armor strip and the tube.

BRIEF DESCRIPTION OF THE DRAWINGS

So that the manner in which the features, advantages and objects of the disclosure, as well as others which will become apparent, are attained and can be understood in more detail, more particular description of the disclosure briefly summarized above may be had by reference to the embodiment thereof which is illustrated in the appended drawings, which drawings form a part of this specification. It is to be noted, however, that the drawings illustrate only a preferred embodiment of the disclosure and is therefore not to be considered limiting of its scope as the disclosure may admit to other equally effective embodiments.

DETAILED DESCRIPTION OF THE DISCLOSURE

Figure 1:
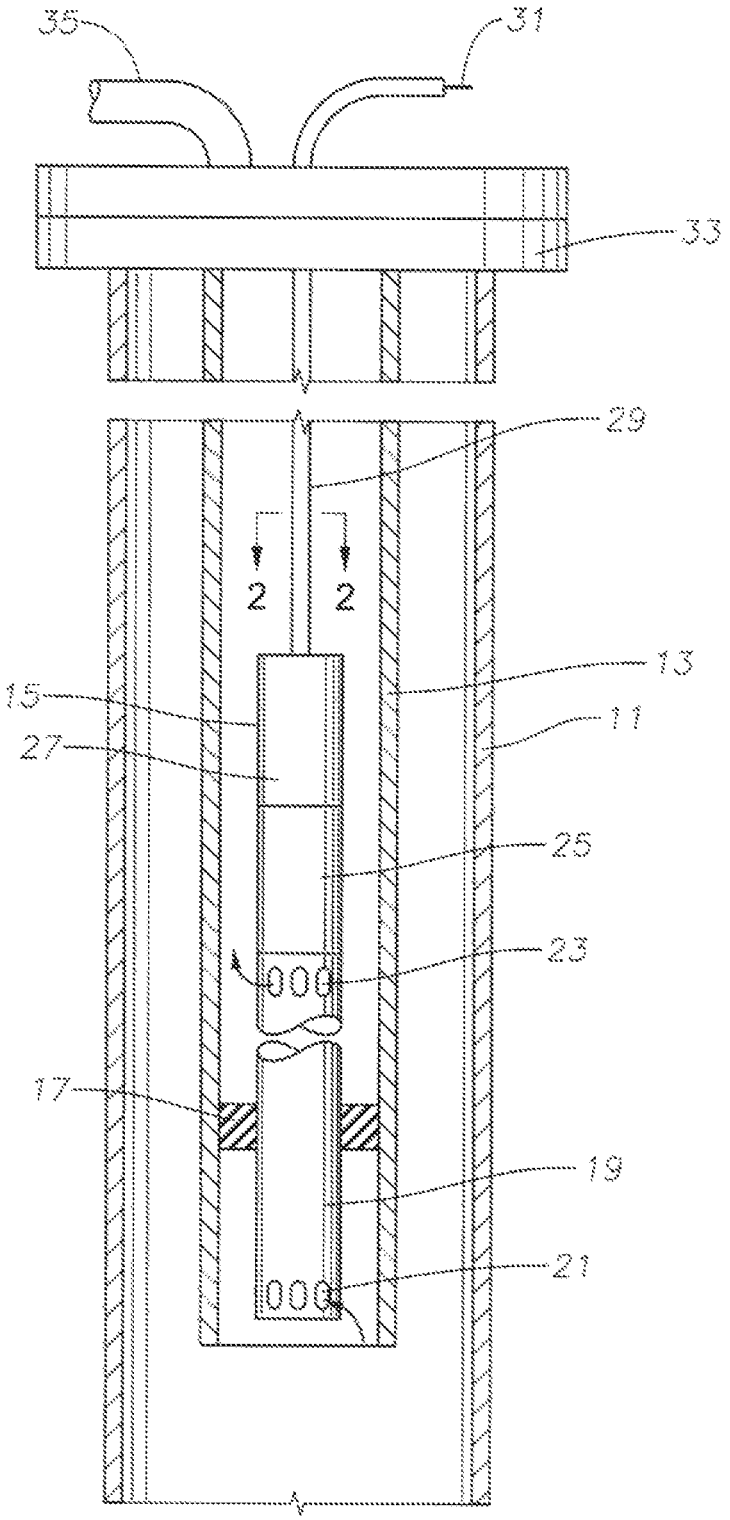
FIG. 1 is a schematic view of an electrical submersible pump assembly supported by coiled tubing containing a power cable in accordance with this disclosure.

The methods and systems of the present disclosure will now be described more fully hereinafter with reference to the accompanying drawings in which embodiments are shown. The methods and systems of the present disclosure may be in many different forms and should not be construed as limited to the illustrated embodiments set forth herein; rather, these embodiments are provided so that this disclosure will be thorough and complete, and will fully convey its scope to those skilled in the art. Like numbers refer to like elements throughout.

It is to be further understood that the scope of the present disclosure is not limited to the exact details of construction, operation, exact materials, or embodiments shown and described, as modifications and equivalents will be apparent to one skilled in the art. In the drawings and specification, there have been disclosed illustrative embodiments and, although specific terms are employed, they are used in a generic and descriptive sense only and not for the purpose of limitation.

Referring to FIG. 1, the well includes casing 11, which will be cemented in place. In the embodiment shown, a tubular liner 13 extends through the casing 11. Liner 13, which serves as production tubing, is of a conventional type, having sections secured together by threads. Liner 13 is not cemented in the well. An electrical pump assembly (ESP) 15 is supported inside liner 13. A packer 17 supports ESP 15 in liner 13 and seals the annulus around ESP 15. Typically, ESP 15 has a stinger (not shown) on its lower end that slides into a polished bore in packer 17.

ESP 15 includes a centrifugal pump 19 of conventional design. Alternately, pump 19 could be another type of pump, such as a progressing cavity pump or a linear reciprocating pump. In this example, pump 19 has a lower end located below packer 17. Pump 19 has intake ports 21 below packer 17 and discharge ports 23 located above packer 17 for discharging well fluid pumped from the well. Packer 17 seals the annulus between ESP 15 and liner 13, and pump 19 draws well fluid from below packer 17 and discharges it into the annulus above packer 17.

An electrical motor 27, normally a three phase type, is coupled to a seal section 25, which in turn connects to pump 19. Seal section 25 has components to reduce a pressure differential between lubricant contained in motor 27 and the well fluid. A shaft (not shown) extends from motor through seal section 25 and into pump 19 to rotate pump 19. The upper end of motor 27 has an adapter (not shown), which may be of various types, and serves as means for securing ESP 15 to a lower end of a length of coiled tubing 29.

Coiled tubing 29 contains a power cable 31 for motor 27 and also supports the weight of power cable 31 and ESP 15 while ESP 15 is being lowered into the well. Although motor 27 is shown mounted above seal section 25 and pump 19, the assembly could be inverted with motor 27 at the lower end.

Coiled tubing 29 is metal, flexible tubing of a type that will be coiled on a reel (not shown) located at the surface before ESP 15 is deployed. A production tree 33 at the upper end of casing 11 provides pressure and flow control. A flow line 35 extends from tree 33 for delivering well fluids pumped by ESP 15. Production tree 33 provides support for the upper end of coiled tubing 29.

Figure 2:
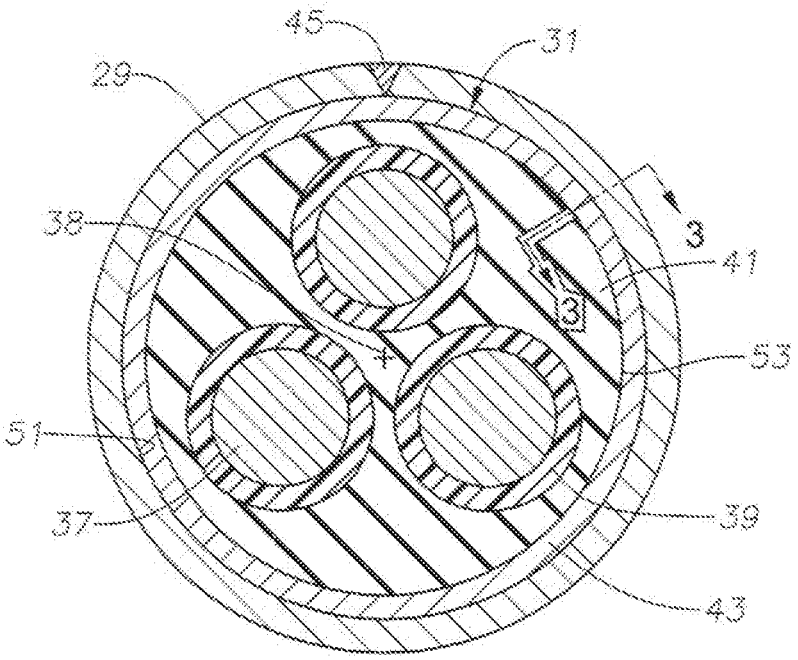
FIG. 2 is a transverse cross sectional view of the power cable within coiled tubing of the pump assembly of FIG. 1.

Referring to FIG. 2, power cable 31 includes three electrical conductors 37 for delivering power to motor 27. Each conductor 37 is of electrically conductive material, such as copper. At least one electrical insulation layer 39 surrounds each conductor 37. Insulated conductors 37 are twisted about each other along a power cable center line 38. At any point, when viewed in a transverse cross-section perpendicular to power cable center line 38, insulated conductors 37 will appear oriented 120 degrees apart from each other. The twisting of insulated conductors 37 enables power cable 31 to be rolled onto a reel.

An elastomeric jacket 41, also of a conventional material, is extruded around all three of the insulated conductors 37. Jacket 41 may be either electrically conductive or electrically non-conductive, and it optionally may have longitudinally extending grooves or ridges (not shown) on its cylindrical exterior. Insulation layer 39 and jacket 41 may be of a variety of conventional polymeric insulation materials. Suitable materials include the following: EPDM (ethylene propylene dienne monomer), NBR (nitrite rubber), HNB Hydrogenated Nitrile rubber, FEPM aflas rubber, FKM rubber, polypropylene (PP), polyethylene (PE) cross-linked PE or PP, thermoplastic elastomers, fluoropolymers, thermoplastics or thermoset elastomers.

Power cable 31 includes a metal band, tape or strip 43 wrapped helically around jacket 41. Metal strip 43 is preferably formed of a steel material, although Monel, aluminum copper or other metals are feasible. The turns of metal strip 43 overlap and preferably interlock with each other. As shown also in FIG. 3, metal strip 43, also referred to as an armor, may have a generally S-shaped or sinusoidal shaped configuration in cross section. Metal strip 43 has an inward facing curved valley or concave surface 43*a* that terminates in an inward facing edge 43*b*, relative to power cable center line 38 (FIG. 2). Metal strip 43 has an outward facing curved valley or convex surface 43*c* that terminates in an outward facing edge 43*d*. Inward and outward facing valleys 43*a*, 43*c* join each other in a curved central transition area. The edges 43*b* and 43*d* of one turn of metal strip 43 overlap with edges 43*b*, 43*d* of adjacent turns of metal strip 43. Edges 43*b* and 43*d* are at opposite margins of metal strip 43. Inward facing edge 43*b* extends into and may touch the outer surface of outward facing valley 43*c* of an adjacent turn. Outward facing edge 43*d* extends into and may touch the inner surface of inward facing valley 43*a* of the other adjacent turn. Metal strip 43 thus fully surrounds jacket 41.

Metal strip 43 is radially deformed from an original transverse or radial dimension prior to installation of power cable 31 in coiled tubing 29 to a smaller radial dimension. An annular gap 49 exists between inner diameter 51 of coiled tubing 29 and the outer diameter 53 of jacket 41. After power cable 31 is installed within coiled tubing 29, annular gap 49 has a radial thickness or dimension that is less than the initial radial dimension of metal strip 43 measured from the innermost point of outward facing valley 43*c* to the outermost point of inward facing valley 43*a*. The smaller dimension of annular gap 49 deforms metal strip 43 to the same radial dimension, thereby placing metal strip 43 in tight frictional engagement with coiled tubing inner diameter 51. The deformation of metal strip 43 may be elastic or permanent. Apart from coiled tubing 29, power cable 31 typically will not support its own weight within an oil producing well because of the long length. The friction created by metal strip 43 being deformed against inner diameter 51 of coiled tubing 29 is adequate to transfer the weight of power cable 31 to coiled tubing 29.

Power cable 31 is formed, then installed in coiled tubing 29 while coiled tubing 29 is being manufactured. Power cable 31 will be formed conventionally, with metal strip 43 wrapped tightly around and in frictional engagement with jacket 41. When power cable 31 is installed during manufacturing, coiled tubing 29 is rolled from a flat strip into a cylindrical shape, and a weld is made of the abutting edges, as shown by weld seam 45.

Figure 4:
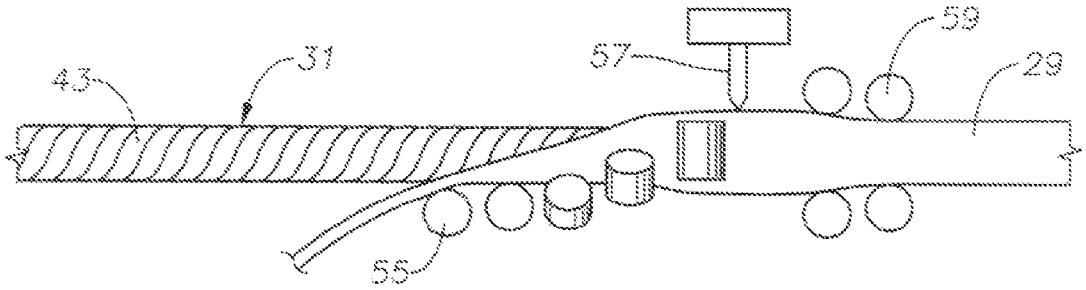
FIG. 4 is schematic view of the coiled tubing being formed and welded around the power cable of FIG. 2.

FIG. 4 schematically illustrates a manufacturing process of installing power cable 31 in coiled tubing 29 while the coiled tubing is being manufactured. Forming rollers 55 deform a flat plate into a cylindrical configuration around power cable 31 in a continuous process. Then a welding device, such as a laser torch 57, welds seam 45. Metal strip 43 avoids direct contact of laser 57 with the elastomeric jacket 41, which otherwise would create smoke. The smoke inhibits effective welding of weld seam 45. Metal strip 43 also reduces the amount of heat received by jacket 41 from laser torch 57.

Figure 3:
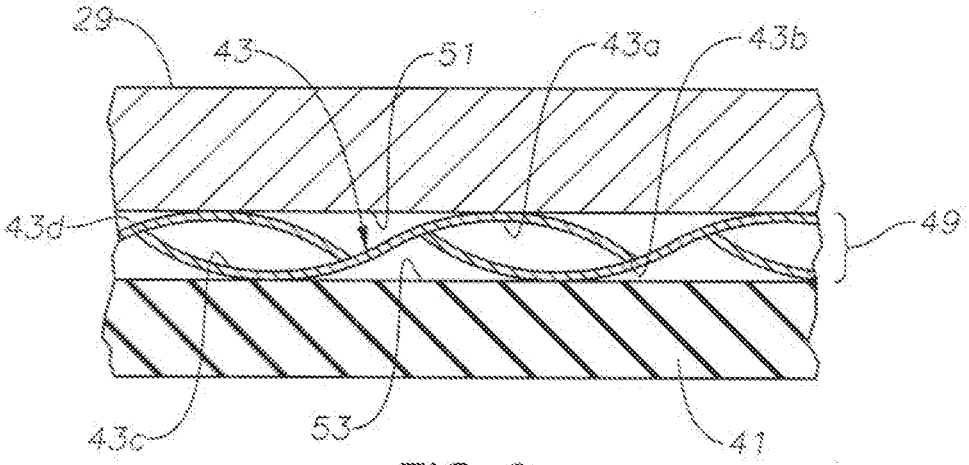
FIG. 3 is a longitudinal cross sectional view of a portion of the power cable and coiled tubing of FIG. 2, taken along the line 3-3 of FIG. 2.
Figure 5:
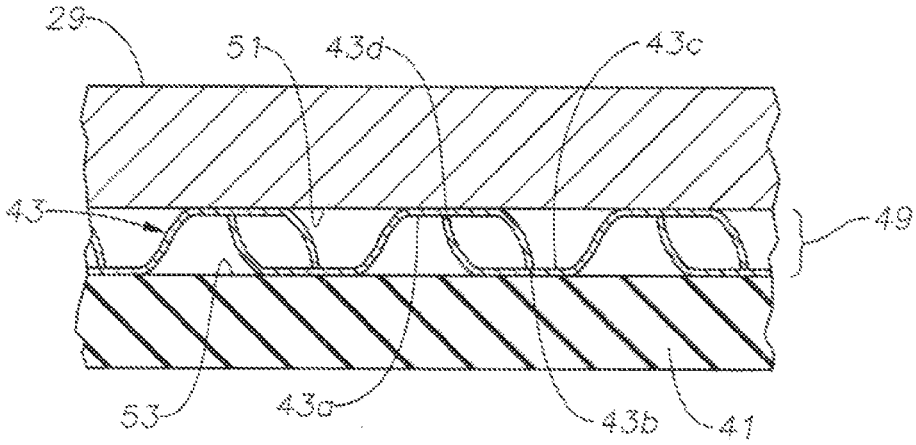
FIG. 5 is a longitudinal cross sectional view of the power cable being formed in FIG. 4, after welding and before swaging.

After welding, coiled tubing 29 undergoes a swaging process with swage rollers 59 to reduce the initial diameter of coiled tubing 29 to a final diameter. Referring to FIG. 5, before the swaging process, annular gap 49 will have a greater radial thickness than afterward (FIG. 3). The radial dimension of metal strip 43 is likewise greater before the swaging process than afterward. Before the swaging process, metal strip 43 may be touching coiled tubing inner diameter 51, or there could be a slight clearance, or even some radial compression. The swaging process causes the radial dimension of annular gap 49 (FIG. 5) to reduce to the radial dimension of annular gap 49 to that shown in FIG. 3. The reduction in radial dimension more tightly compresses metal strip 43 to increase the frictional engagement of metal strip 43 with coiled tubing 29. During the swaging process, inward facing edges 43*b* slide on outward facing valleys 43*c*. Outward timing edges 43*d* slide on inward facing valleys 43*a*. Valleys 43*a* and 43*c* reduce in radial dimension during the swaging process. The material of jacket 41 is preferably non compressible, although jacket 41 can be deformed. The outer diameter 53 of jacket 41 thus may remain constant during the swaging process.

As an example, metal strip 43 may be formed of a material having a thickness in the range from 0.003 to 0.040 inch. While being radially deformed by the swaging process, the radial dimension of metal strip 43 and gap 49 map decrease by an amount in the range from about 0.005 to 0.025 inch. In this example, the swaging process thus decreases coiled tubing inner diameter 51 by an amount from about 0.010 to 0.050 inch, but it could be more.

Coiled tubing 29 is not annealed after the welding process, thus may be ready for use after the swaging process. During operation of ESP 15 (FIG. 1), the spaces between inward facing valleys 43*a* and jacket outer diameter 53 and the spaces between outward facing valleys 43*c* and coiled tubing inner diameter 51 provide additional room for the material of jacket 41 to distort and flow to relieve forces resulting from thermal expansion.

Figure 6:
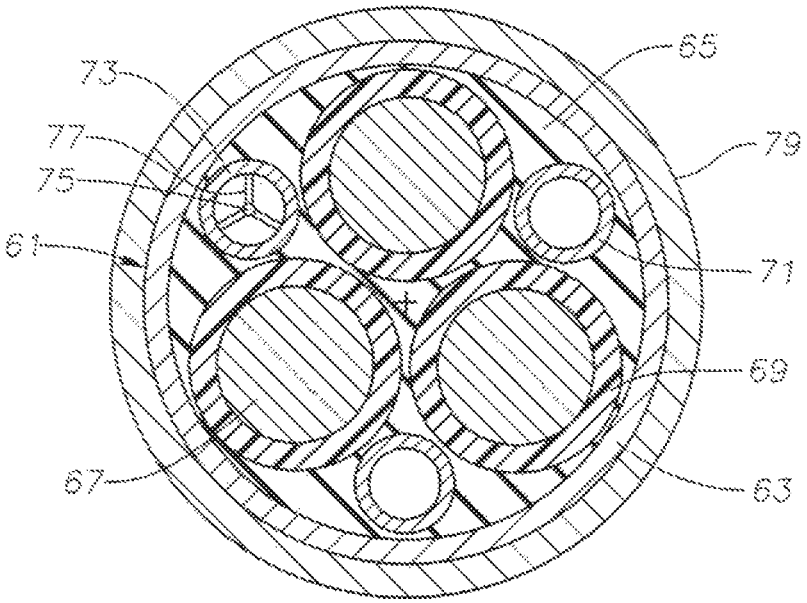
FIG. 6 is a transverse sectional view of an alternate embodiment of power cable within coiled tubing.

FIG. 6 illustrates an alternate embodiment in a transverse cross section. Power cable 61 has a metal strip 63 wrapped helically around the cylindrical exterior of elastomeric jacket 65. Metal strip 63 may have the same configuration as metal strip 43 of the first embodiment. Three electrical motor power conductors 67 are encased in jacket 65, each conductor 67 having at least one or more insulation layers 69. Conductors 67 are spaced 120 degrees apart from each other relative to the centerline of power cable 61.

In this example, two fluid conveying tubes 71 and one signal wire tube 73 are shown embedded within jacket 65. Tubes 71 and 73 extend alongside conductors 67 the length of power cable 61. Normally, conductors 67 twist relative to each other along the length of power cable 61, and tubes 71, 73 will also twist in the same manner. Tubes 71, 73 are preferably symmetrically spaced around the centerline of power cable 61. If three tubes 71, 73 are employed, preferably they are located 120 degrees apart from each other relative to the centerline of power cable 61. Each tube 71, 73 is positioned between two of the conductors 67. The centerline or axis of each tube 71, 73 may be slightly farther from the centerline of power cable 61 than the centerlines of conductors 67. Tubes 71, 73 optionally may be smaller in diameter than the outer diameters of insulation layers 69. Preferably, the elastomeric material of jacket 65 is extruded completely around each tube 71, 73. Tubes 71, 73 may be formed of a metal, such as Monel.

Fluid conveying tubes 71 are hollow and employed to convey fluids to and/or from ESP 15 (FIG. 1). For example, the fluids may comprise hydraulic fluid and/or liquid chemicals employed to assist in well fluid production.

Signal wire tube 73 contains an instrument wire 75 for transmitting signals to and/or from ESP 15 (FIG. 1). The signals may concern well fluid parameter measurements, such as pressure and temperature. As an example, instrument wire 75 may be supported in in a standoff 77 in signal wire tube 73, and the remaining portions of signal wire tube 73 may be filled with an electrical insulation powder. The number of signal wire tubes 73 and fluid conveying tubes 71 may vary. In some embodiments, all of the tubes within the jacket of the power cable may comprise signal tubes, or all may comprise fluid conveying tubes. A single tube within a power cable is feasible.

Power cable 61 is installed within coiled tubing 79 while coiled tubing 79 is being formed and seam welded in the same manner as in the first embodiment. Metal strip 63 will be radially deformed between jacket 65 and the inner diameter of coiled tubing 79 to frictionally grip the inner diameter of coiled tubing 79. The radial dimension of metal strip 65 decreases from its initial dimension while coiled tubing 79 is swaged after being welded. Preferably, the radial deformation of metal strip 63 is elastic, but it could be permanent. Metal strip 63 creates an outward bias force against the inner surface of coiled tubing 79.

Figure 7:
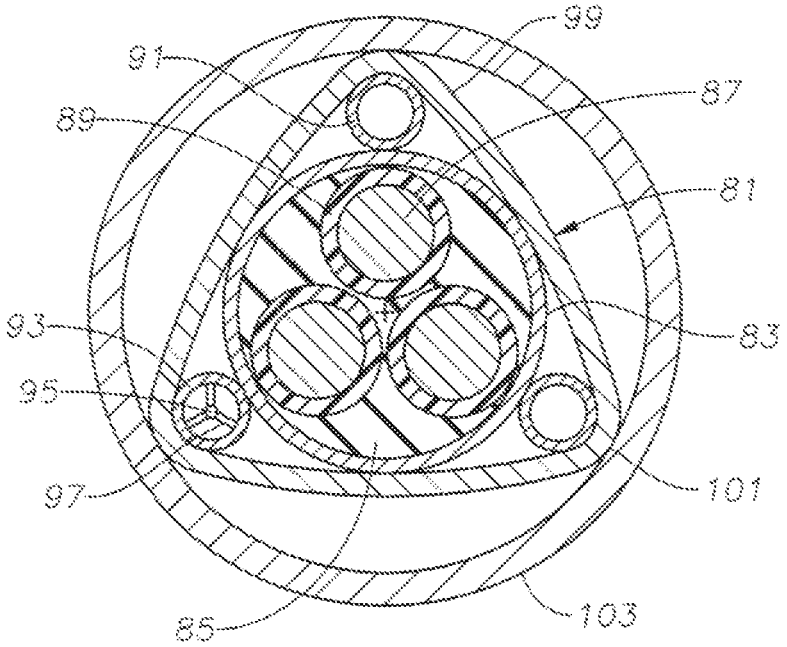
FIG. 7 is a transverse sectional view of another alternate embodiment of power cable within coiled tubing.

FIG. 7 illustrates another embodiment. Power cable 81 has an inner metal strip 83, also referred to as a metal armor strip, wrapped around an elastomeric jacket 85 in the same manner as in the first two embodiments. Inner metal strip 83 may have the same configuration as metal strip 43 of FIG. 2. Jacket 83 is extruded around three electrical conductors 87, each having at least one insulation layer 39.

In this example, two fluid conveying tubes 91 and a signal wire tube 93 form a part of power cable 81. Rather than being embedded within jacket 85 as in the embodiment of FIG. 6, tubes 91, 93 are located on the exterior of inner metal strip 83. Fluid conveying tubes 91 serve to convey fluid to and/or from ESP 15 (FIG. 1). Signal wire tube 93 contains an instrument wire 95 to transmit signals to and/or from ESP 15. Instrument wire 95 may be supported in a standoff 97 surrounded by an electrical insulation powder.

The number of tubes 93, 95 may vary. All of the tubes 93,95 may serve to convey fluid, or all may serve to transmit signals. Preferably tubes 93, 95 are symmetrically spaced around inner metal strip 13. In this example, tubes 93, 95 are spaced 120 degrees apart from each other relative to the centerline of power cable 81. Tubes 93, 95 are smaller in outer diameter than the outer diameter of inner metal strip 83 and optionally may have a smaller outer diameter than the outer diameter of insulation layers 69.

An outer metal strip 99 wraps helically around the assembled tubes 93,95 and inner metal strip 83. Outer metal strip 99 may have the same configuration as metal strip 43 of the first embodiment. With three tubes 93, 95, outer metal strip 99 has a generally triangular appearance when viewed in the transverse cross section of FIG. 7. Outer metal strip 99 has three corner portions 101, each of which extends around in tight contact with the outer portion of one of the tubes 91, 93. Outer metal strip 99 has intermediate portions between corner portions 101 that will contact inner metal strip 83 at a point equidistant between two of the tubes 91, 93.

Power cable 81 is installed within coiled tubing 103 in the same manner as the other embodiments. As coiled tubing 103 is being swaged after its seam is welded, inner surface portions of coiled tubing 103 will contact and radially deform corner portions 101 of outer metal strip 99. Initially, the transverse or radial dimension of outer metal strip 99 at corner portions 101 is greater. The swaging process of coiled tubing 103 reduces the radial dimensions at corner portions 101, causing corner portions 101 to frictionally grip inner surface portions of coiled tubing 103. The reduction in radial thickness creates a bias force of corner portions 101 against inner surface portions of coiled tubing 103. The deformation may be elastic or permanent.

While the disclosure has been shown in only a few of its forms, it should be apparent to those skilled in the art that it is not so limited, but is susceptible to various changes without departing from the disclosure.

The invention claimed is:

1. An electrical submersible well pump assembly, comprising:

a pump driven by an electrical motor;

a string of tubing connected to the well pump assembly and adapted to extend to an upper end of a well;

a power cable installed in the tubing, the power cable comprising:

three insulated electrical conductors embedded within an elastomeric jacket;

a metal strip having turns wrapped helically around the jacket;

the metal strip being compressed between the jacket and the tubing to cause the power cable to frictionally grip the tubing; and wherein:

when viewed in a transverse cross section, each of the turns of the metal strip defines an outward facing curved valley and an inward facing curved valley, relative to a centerline of the power cable, the outward facing curved valley joining the inward facing curved valley at a curved transition area, each of the outward facing and inward facing curved valleys having an edge at a margin of the metal strip;

the edge of the inward facing curved valley being in contact with an outer surface of the outward facing curved valley; and the edge of the outward facing curved valley being in contact with an inner surface of the inward facing curved valley.

2. The assembly according to claim 1, wherein the metal strip is elastically deformed between the jacket and the tubing.

3. The assembly according to claim 1, wherein prior to installation of the power cable in the tubing and after the metal strip is wrapped around the jacket, the metal strip has a radial dimension between an inner side and an outer side that is greater than the radial dimension of the metal strip after installation of the power cable in the tubing.

4. The assembly according to claim 1, further comprising at least one tube embedded within the jacket alongside the conductors and extending along a length of the power cable.

5. The assembly according to claim 1, further comprising:

at least one tube extending alongside and exterior of the jacket along a length of the power cable; and wherein each turn of the metal strip extends around the tube and the jacket.

6. The assembly according to claim 1, further comprising:

a metal armor strip wrapped helically around and in physical contact with the jacket;

at least one tube extending alongside and in contact with the metal armor strip along a length of the power cable; and wherein each turn of the metal strip extends around the tube and the metal armor strip and is in physical contact with the tube, the metal armor strip and the tubing.

7. An electrical submersible well pump assembly, comprising:

a pump driven by an electrical motor;

a string of metal coiled tubing connected to the well pump assembly and adapted to extend to an upper end of a well;

a power cable installed in the coiled tubing, the power cable comprising:

three insulated electrical conductors embedded within an elastomeric jacket, the conductors being spaced 120 degrees apart from each other relative to a centerline of the power cable, the jacket having a cylindrical exterior;

a metal strip having turns wrapped helically around the jacket, the turns of the metal strip having an inner diameter surface in contact with an outer surface of the jacket and an outer diameter surface in contact with an inner surface of the coiled tubing; and wherein the turns of the metal strip are radially deformed relative to the centerline of the power cable between the inner diameter surface and the outer diameter surface such that the metal strip exerts a radial inward force from the inner diameter surface against the outer surface of the jacket and an outward radial force from the outer diameter surface against the inner surface of the coiled tubing to cause the power cable to frictionally grip the coiled tubing.

8. The assembly according to claim 7, wherein:

when viewed in a transverse cross section the metal strip has a generally S-shaped configuration, defining an outward facing curved valley and an inward facing curved valley, relative to the centerline of the power cable; and the inward facing curved valley of each turn of the metal strip overlaps the outward facing curved valley of an adjacent one of the turns.

9. The assembly according to claim 7, wherein:

when viewed in a transverse cross section, each of the turns of the metal strip defines an outward facing curved valley and an inward facing curved valley, relative to the centerline of the power cable, the outward facing curved valley joining the inward facing curved valley at a curved transition area, each of the outward facing and inward facing curved valleys having an edge at a margin of the metal strip;

the edge of the inward facing curved valley being in contact with an outer surface of the outward facing curved valley; and the edge of the outward facing curved valley being in contact with an inner surface of the inward facing curved valley.

10. The assembly according to claim 7, wherein the radial deformation of the metal strip is elastic.

11. The assembly according to claim 7, further comprising three tubes symmetrically spaced and embedded within the jacket alongside the conductors and extending along a length of the power cable.

12. An electrical submersible well pump assembly, comprising:

a pump driven by an electrical motor;

a string of metal coiled tubing connected to the pump assembly and adapted to extend to a wellhead;

a power cable electrically connected to the motor and extending through the coiled tubing for supplying power to the motor, comprising:

three insulated electrical conductors embedded within an elastomeric jacket;

a metal strip having turns wrapped helically around the jacket, overlapping with each other, and the turns of the metal strip having an inner diameter surface in contact with an outer surface of the jacket and an outer diameter surface in contact with an inner surface of the coiled tubing;

the turns of the metal strip having an initial radial thickness, relative to a centerline of the power cable, and measured from the inner diameter surface to the outer diameter surface prior to installation of the power cable in the coiled tubing; and the turns of the metal strip having a final radial thickness measured from the inner diameter surface to the outer diameter surface after installation of the power cable in the coiled tubing that is less than the initial radial thickness, so as to create a bias force from the inner diameter surface of the turns of the metal strip against the outer surface of the jacket and from the outer diameter surface of the turns of the metal strip against the inner surface of the coiled tubing.

13. The assembly according to claim 12, wherein the metal strip is elastically deformed against the outer surface of the jacket and against the inner surface of the coiled tubing.

14. The assembly according to claim 12, wherein:

when viewed in a transverse cross section, each of the turns of the metal strip defines an outward facing curved valley and an inward facing curved valley, relative to the centerline of the power cable, the outward facing curved valley joining the inward facing curved valley at a curved transition area, each of the outward facing and inward facing curved valleys having an edge at a margin of the metal strip;

the edge of the inward facing curved valley being in contact with an outer surface of the outward facing curved valley; and the edge of the outward facing curved valley being in contact with an inner surface of the inward facing curved valley.

15. The assembly according to claim 12, wherein a difference between the initial radial thickness and the final radial thickness of the metal strip is in the range from 0.005 to 0.025 inch.

* * * * *